United States Patent [19]

Spiess et al.

[11] Patent Number: 4,909,664

[45] Date of Patent: Mar. 20, 1990

[54] ARRANGEMENT FOR DRAINING LIQUID COLLECTING ON A GROUND SURFACE

[75] Inventors: Hansruedi Spiess, Delemont; Francois Galvanetto, Alle, both of Switzerland

[73] Assignee: Von Roll, AG., Gerlafingen, Switzerland

[21] Appl. No.: 250,345

[22] Filed: Sep. 28, 1988

[30] Foreign Application Priority Data

Oct. 12, 1987 [CH] Switzerland ..... 3975/87

[51] Int. Cl.[4] ..... E02B 13/00

[52] U.S. Cl. ..... 405/36; 405/52; 404/2

[58] Field of Search ..... 405/52, 258, 270; 52/19, 20; 404/5, 25, 26; 160/398, 404

[56] References Cited

U.S. PATENT DOCUMENTS 4,305,679 12/1981 Modi ..... 52/20 X 4,557,625 12/1985 Jahnke et al. ..... 52/20 X 4,610,568 9/1986 Koerner ..... 405/258 X 4,765,775 8/1988 Kroger ..... 405/52

4,802,792 2/1989 Flessas ..... 405/52 X

*Primary Examiner*—Dennis L. Taylor

*Attorney, Agent, or Firm*—Helfgott & Karas

[57] ABSTRACT

In constructions with a relatively limited ground height, e.g., bridges, flat roofs, etc. the foundation or earthwork is covered with a sealing sheet, which extends up to a drain casing or frame. To avoid a return flow of liquid below the sealing sheet and into the foundation, in the arrangement according to the invention, the edge portion of the sealing sheet is laid downward over the wall of the frame or the casing. A locking frame is placed on the edge portion of the sealing element. The locking frame can additionally be secured in position by vertical threaded bolts and is used for pressing the edge portion of the sealing sheet onto the frame or onto the casing.

4 Claims, 2 Drawing Sheets

ARRANGEMENT FOR DRAINING LIQUID COLLECTING ON A GROUND SURFACE

BACKGROUND OF THE INVENTION

The invention relates to an arrangement for draining off liquid collecting on a ground surface by a drain provided with a frame or a casing and in which for avoiding the penetration of the liquid into the ground, a sealing sheet, film or foil is laid, which extends up to the frame or casing of the drain.

The invention is in the field of draining off rainwater and other liquids from constructions of various types. In connection with roads and squares it is known to collect the liquid at the margins thereof in gutters and to feed it into drains, from where the liquid is drained off underground. The penetration of the liquid into the road body is prevented by a water-repelling surface, e.g. by a bitumen covering layer.

In other constructions, such as e.g., bridges, flat roofs, balconies, etc., it is necessary to reliably prevent the liquid from penetrating below the ground or base surface and special means must be used due to the limited ground depth. It is known to provide a frame or a casing in the foundation or earthwork for draining the liquid and to lay a sealing sheet prior to the application of the covering layer and which extends up to the edge of the frame or the casing. A liquid inlet is then provided in the frame or casing and is oriented at the same height as the covering layer surface.

In connection with a complete sealing by the sealing sheet the disadvantage exists that, on passing from the sheet edge to the edge of the frame, liquid can spread under the sheet and penetrate the foundation, which can be highly disadvantageous if in the case of frost the liquid freezes in the ground and consequently produces cracks.

SUMMARY OF THE INVENTION

It is an object of the present invention to provide an improved drain arrangement of the foregoing type, which would ensure that the penetration of liquid at the transition between the edge of the sealing sheet and the edge of the frame or casing of the drain is reliably avoided.

According to the invention, this and other objects are attained by an arrangement in which, for avoiding a return flow of liquid below the sealing sheet and into the ground, the sealing sheet is laid over the edge of the frame or casing. Due to the fact that the edge of the frame or casing is overlapped by the sealing sheet, there can be a reliable connection with said edge and consequently completely satisfactory sealing would be achieved.

In an embodiment, the edge portion of the sealing sheet can extend downwards over the inner surface of the frame or casing provided with a cylindrical or conical inner wall. An additional securing of the edge portion of the sealing sheet can be achieved in that said edge portion is covered by a fixing frame inserted in the frame or casing.

DETAILED DESCRIPTION OF THE PREFERRED EMBODIMENTS

Figure 1:
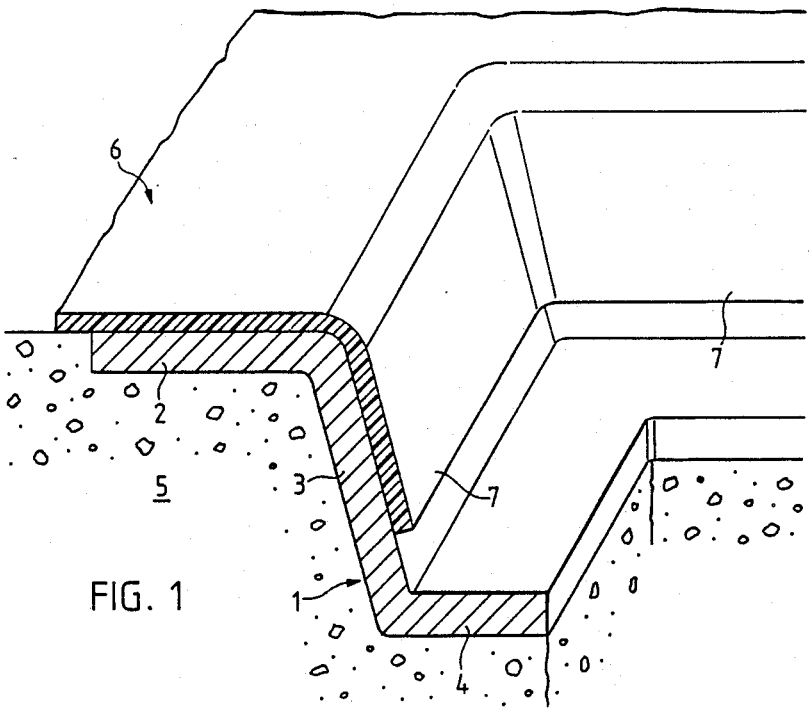
FIG. 1 a diagrammatic, partial view of the arrangement for draining liquids from a ground surface, according to the invention.

The arrangement shown in FIG. 1 has a frame 1 of a not shown drain, which is provided on the outer circumference with an outer flange 2 to which is connected a conically inclined frame wall 3. Inwardly of frame 1, is provided an inner flange 4 which, like the outer flange 2, runs roughly horizontally or conically. The inner flange 4 can also be omitted. Frame 1 is supported in the earthwork or foundation 5. The latter is covered by a sealing sheet which extends over the entire ground surface. Sealing sheet 6 is made from plastic, a plastic-impregnated sheet of paper or a bitumen sheet.

It is important that the edge portion 7 of the sealing sheet extends over the outer flange 2 and downwards over the inner side of frame wall 3 and can be firmly connected to frame 1. It is unimportant whether frame 1 is rectangular, polygonal, round or oval. The edge portion 7 can be correspondingly cut to size to enable the complete frame wall 3 to be covered.

The use of the downwardly directed edge portion 7 on the frame wall 3 is not dependent on the material of frame 1 and this can be made from metal, e.g., cast iron, or from plastic.

As a result of the downwardly directed edge portion 7 of sealing sheet 6 it is reliably ensured that no liquid can flow back below the sealing sheet 6 and penetrate the foundation 5.

Figure 2:
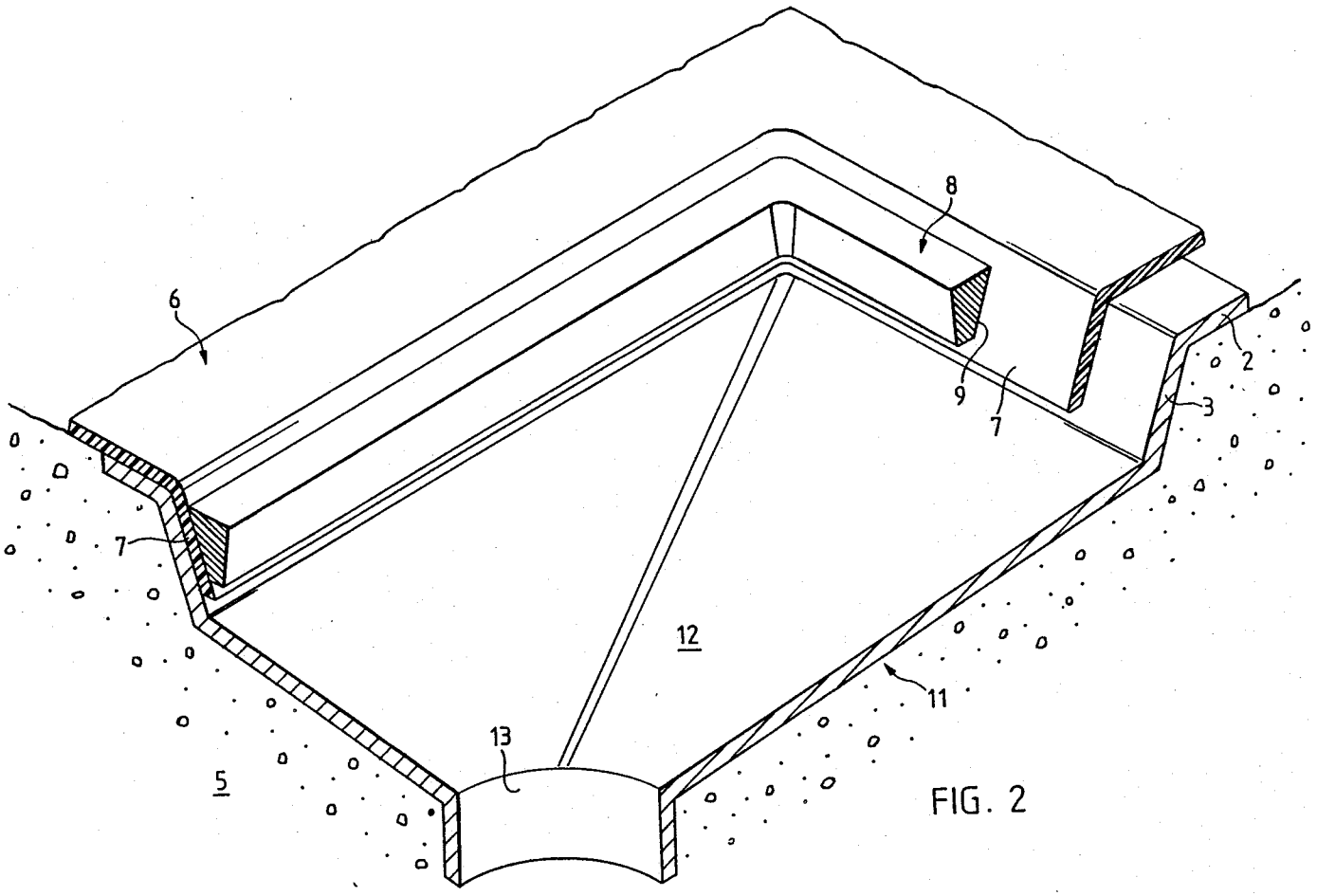
FIG. 2 is a diagrammatic, partial representation of another embodiment of the arrangement for draining off liquids.

The second embodiment of the arrangement shown in FIG. 2 differs from that of FIG. 1 in that the edge portion 7, although also extending downwards over the inner wall of frame wall 3, is additionally provided with a locking ring 8, which is placed on edge portion 7 of sealing sheet 6. Locking ring 8 appropriately has a wall portion corresponding to edge portion 7 and can be placed together therewith in clearance-free manner on edge portion 7 of sealing sheet 6. Thus, the locking ring s is an additional securing means and provides protection against the edge portion slipping away.

This embodiment also reliably avoids a return flow of liquid below the sealing sheet 6 and into the foundation 5.

Figure 3:
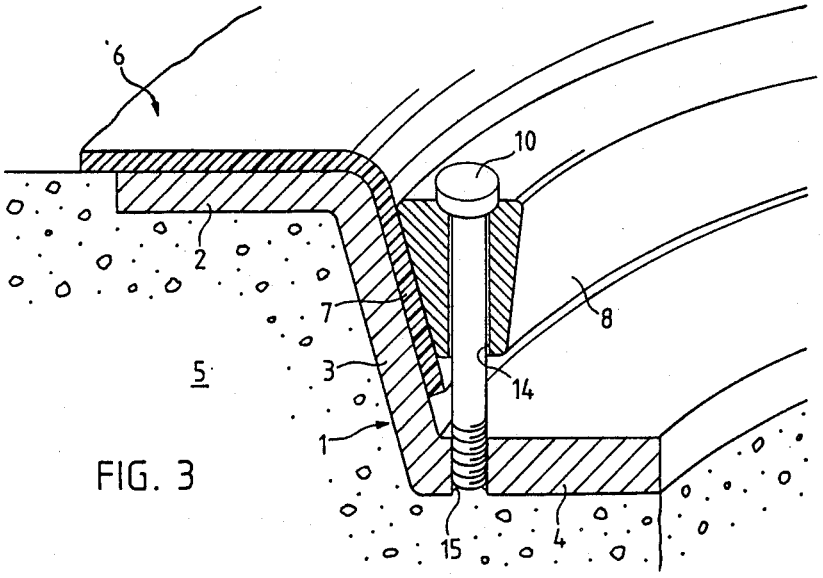
FIG. 3 is a diagrammatic, partial representation of a third embodiment for draining liquids.

FIG. 3 shows a third embodiment of the arrangement having the same parts as that of FIG. 2, i.e., the edge portion 7 of sealing sheet 6 extends downwards over the inner wall of frame wall 3 and is additionally secured by locking ring 8.

Unlike in the construction according to FIG. 2, locking ring 8 is firmly drawn onto the edge portion and frame wall 3 by means of threaded bolts 10, of which only one is shown. For this purpose there are vertical bores 14 in locking ring 8 and tapholes 16 in frame 1.

In FIGS. 1 and 3 frame wall 3 is part of the frame 1, whereas in FIG. 2 frame all 3 is part of casing 11, whose bottom 12 is equipped with a discharge pipe 13.

The described arrangement is characterized by a simple construction, but still provides reliable protection against the liquid flowing back below the sealing sheet 6 and the penetration thereof into the earthwork or foundation 5. The locking ring s reliably prevents any slipping away of edge portion 7.

After laying the frame 1 or the casing 11 as well as the sealing sheet 6 into the foundation 5, the top layer, e.g., of bitumen or concrete is applied and simultaneously in the frame 1 or casing 11 is positioned a frame for the laying of a grating or manhole cover flush with the surface of the top layer.

What is claimed is:

1. Arrangement for draining off liquid collecting on a ground surface, comprising a drain provided with frame means, a sealing sheet covering the ground surface around and adjacent the drain for preventing the penetration of liquid into the ground, and a frame-like locking element inserted in said frame means for maintaining said sealing sheet attached to said frame means, said frame means including an outer flange which is substantially flush with the ground surface and an inclined frame wall surrounded by said outer flange and extending downwardly therefrom, said sealing sheet including a flange portion overlapping said outer flange and an inclined edge portion integral with said flange portion and extending downwardly therefrom over at least a part of said inclined frame wall, said locking element having a wall portion corresponding in shape and inclination to those of said frame wall and being positioned together with said edge portion against said wall in a clearance-free manner therewith.

2. Arrangement according to claim 1, wherein said frame means includes a frame.

3. Arrangement according to claim 1, wherein said frame means includes a casing.

4. Arrangement according to claim 1, wherein the locking element is provided with vertically positioned bores receiving threaded bolts, which for fixing the edge portion of the sealing sheet by the locking element are screwed into tapholes provided in the frame means below the locking element.

* * * * *